US008042916B2

(12) United States Patent
Wang

(10) Patent No.: US 8,042,916 B2
(45) Date of Patent: Oct. 25, 2011

(54) MICROMACHINED FLUID EJECTOR ARRAY

(75) Inventor: Yunlong Wang, Fremont, CA (US)

(73) Assignee: Micropoint Biosciences, Inc., Sunnyvale, CA (US)

( * ) Notice: Subject to any disclaimer, the term of this patent is extended or adjusted under 35 U.S.C. 154(b) by 1222 days.

(21) Appl. No.: 11/694,943

(22) Filed: Mar. 31, 2007

(65) Prior Publication Data

US 2008/0239025 A1 Oct. 2, 2008

(51) Int. Cl.
*B41J 2/045* (2006.01)
*B41J 2/14* (2006.01)

(52) U.S. Cl. ..... 347/70; 347/47; 347/68

(58) Field of Classification Search ..... 347/47, 347/68–72; 310/324
See application file for complete search history.

(56) References Cited

U.S. PATENT DOCUMENTS 6,445,109 B2 9/2002 Percin et al.
6,474,786 B2 11/2002 Percin et al.
6,474,787 B1 11/2002 Cruz-Uribe
6,712,455 B2 3/2004 Dante
6,749,283 B2 6/2004 Sanada
2003/0081064 A1 5/2003 Dante et al.
2007/0064068 A1 3/2007 Piatt et al.

*Primary Examiner* — Geoffrey Mruk
(74) *Attorney, Agent, or Firm* — Gary Baker; Quine Intellectual Property Law Group, P.C.

(57) ABSTRACT

This invention relates to a micromachined fluid ejector array having a fluid reservoir bounded at one side by an elastic membrane having scalable arrays of orifices arranged between concentric piezoelectric transducers, and at another side by a top cover supported by surrounding walls. By actuating neighboring concentric piezoelectric transducers, the scalable array of orifices arranged between the actuated neighboring concentric piezoelectric transducers deflect to eject fluid droplets. Also disclosed is a micromachined fluid ejector array having a fluid reservoir bounded at one side by an elastic membrane having scalable arrays of orifices arranged between concentric piezoelectric transducers, and at another side by a top cover supported by surrounding walls. A piezoelectric layer is bonded on top of the top cover. By actuating the piezoelectric layer bonded on top of the top cover, the scalable arrays of orifices arranged between the neighboring concentric piezoelectric transducers deflect in phase to eject fluid droplets.

15 Claims, 6 Drawing Sheets

MICROMACHINED FLUID EJECTOR ARRAY

CROSS REFERENCE TO RELATED APPLICATION

U.S. Patent Documents: U.S. Pat. Nos. 6,445,109; 6,474,786; 6,712,455; 6,749,283; 2003/0081064.

BACKGROUND OF THE INVENTION

Fluid droplet ejectors have been mostly associated with the printing business. Nozzles of various kinds have been reported in many publications and are commercially available. These nozzles are typically used to allow the formation and control of small ink droplets that result in high quality printing on demand.

Typically, an ink printhead has apertures or nozzles from which ink droplets are expelled onto a print medium, and the ink is routed internally through the printhead. Conventional methods of ejecting inks onto the print medium include piezoelectric transducers and bubbles formed by heat pulses to force fluid out of the nozzles. In situations where a printhead includes multiple nozzles, if one desires to selectively expel ink droplets from a specific nozzle and not the other nozzles, conventional solutions known in the art, isolate the nozzles from each other by long narrow passages that damp pressure surges in the ink fluid provided to the nozzles from a common source. Heaters can also be located at each nozzle, for the purpose of reducing ink viscosity at a specific nozzle. Thus, when a droplet is to be ejected from a specific nozzle, the heater at that nozzle is activated to heat ink at the nozzle so that when a pressure pulse is applied to the ink fluid, the ink viscosity at the nozzle is reduced enough so that a droplet of ink will be expelled from the nozzle, while the higher viscosity of the (colder) ink at the other nozzles remains high enough to prevent ejection of ink droplets from those other nozzles.

In U.S. Pat. No. 6,712,455, it is reported that a printhead includes a common ink chamber or reservoir bounded on one side by a membrane having nozzle apertures. The membrane forms a print face of the printhead. Piezoelectric elements (piezos) are located on the membrane near the nozzles. The piezos flex segments of the membrane surrounding the nozzles to eject ink droplets from the nozzle apertures. Ribs are also provided on the membrane and define boundaries of the membrane segments corresponding to the nozzles. The ribs can isolate each nozzle from the other nozzles, in two ways. First, the ribs act as stiffeners so that when piezos attached to one membrane segment flex that membrane segment, the other membrane segments are not significantly flexed. Second, when the ribs are provided on an interior surface of the membrane, they deflect the pressure pulse in the ink fluid from a flexing membrane segment, upwards, away from adjacent membrane segments/nozzles.

Micromachined droplet ejectors have also been reported in U.S. Pat. Nos. 6,445,109 and 6,474,786. This type of droplet ejectors include a cylindrical reservoir closed at one end with an elastic membrane including at least one aperture. A bulk actuator at the other end for actuating the fluid for ejection through the aperture. The ejector array is a micromachined two-dimensional array droplet ejector. The ejector includes a two-dimensional array of elastic membranes having orifices closing the ends of cylindrical fluid reservoirs. The fluid in the ejectors is bulk actuated to set up pressure waves in the fluid which cause fluid to form a meniscus at each orifice. Selective actuation of the membranes ejects droplets. In an alternative mode of operation, the bulk pressure wave has sufficient amplitude to eject droplets while the individual membranes are actuated to selectively prevent ejection of droplets.

These conventional and micromachined print heads or fluid ejectors suffer from various disadvantages. First, they usually require a large interconnected reservoir to store the ink or fluid. The fluid can only be ejected when this reservoir is fully filled, which usually results in large waste because these are considered dead volume. Second, the print head or ejector array has many long, narrow passages for transmitting ink to a particular nozzle. Third, many of these print heads and fluid ejectors address the need to selectively eject fluid from one particular nozzle. Because of manufacturing differences, however, these devices are not suitable to uniformly eject fluid in pico-liter quantities.

In biochemistry or related applications, there is a need for fluid ejectors that can control the fluid ejection at pico-liter level reliably. The fluid ejector is also required to have small dead volume so that there is least waste of biochemical reagents. In addition, it needs to eject fluid droplets uniformly across all orifices without satellite drops.

OBJECTS AND SUMMARY OF THE INVENTION

It is an object of the present invention to provide a micromachined fluid ejector array.

It is another object of the present invention to provide a micromachined fluid ejector array that has a smaller dead volume.

It is a further object of the present invention to provide a micromachined fluid ejector array that comprises a concentric array of piezoelectrically actuated flextensional transducers.

It is a further object of the present invention to provide a micromachined fluid ejector array comprising a concentric array of piezoelectrically actuated flextensional transducers. A scalable array of orifices are filled between neighboring concentric flextensional transducers. By actuating these neighboring transducers, the scalable array of orifices eject fluid droplets.

It is another object of the present invention to provide a micromachined fluid ejector array comprising a concentric array of piezoelectrically actuated flextensional transducers, each neighboring concentric flextensional transducers or all flexensional transducers can be actuated to eject fluid droplets.

It is a further object of the present invention to provide a micromachined fluid ejector array that is bounded by a flextensional membrane at one end. The membrane is piezoelectrically actuated to eject fluid drops.

It is another object of the present invention to provide a micromachined fluid ejector array that is bounded on the other end by a cover or a piezoelectric material. Electrically actuating the piezoelectric material, the fluid ejector array ejects fluid droplets from all orifices in phase.

The foregoing and other objects of the invention are achieved by a micromachined fluid ejector array that is bounded by a flextensional membrane that is electrostatically positioned at one end and a cover at the other end. A piezoelectric layer may be bonded on top of the top cover. Concentric array of piezoelectric transducers are arranged on the flextensional membrane. A scalable array of orifices, which are photolithographically made using micromachining, are on the flextensional membrane. Actuating the neighboring concentric piezoelectric transducers, the orifices spaced between these transducers will eject fluid droplet. Actuating all concentric piezoelectric transducers makes all orifices eject fluid droplets according to the driving frequency. Actuating piezoelectric transducer layer bonded on top of the top cover makes all orifices eject fluid droplets in phase.

BRIEF DESCRIPTION OF THE DRAWINGS

The foregoing and other objects of the invention will be more clearly understood from the following description when read in conjunction with the accompanying drawings of which.

DESCRIPTION OF THE PREFERRED EMBODIMENTS

A fast, reliable method for dispensing picoliters to femtoliters fluid volumes is needed in many emerging areas of biomedicine and biotechnology. There is also a continuing need for alternative deposition techniques of organic polymers in precision droplet-based manufacturing and material synthesis, such as the deposition of doped organic polymers for organic light emitting devices of flat panel displays, and the deposition of low-k dielectrics for semiconductor manufacturing. A reliable and low-cost droplet ejector array that can supply high quality droplets, e.g., uniform droplet size and ejection without satellite droplets, at high ejection frequencies and high spatial resolutions is needed.

We designed the droplet ejector to have maximum displacement at the center of neighboring concentric piezoelectric transducers. The vibrating plate has a scalable array of orifices arranged between the neighboring concentric piezoelectric transducers. These transducers are actuated in pairs such that the orifices arranged between them will vibrate to eject fluid droplets. Longitudinal thickness mode piezoelectric material is also used as an actuation mechanism. In this case, all orifices on the membrane will eject the fluid droplets in phase.

The concentric piezoelectric transducers set up capillary waves at the liquid-air interface and raises the pressure in the liquid above atmospheric (as high as 1.5 MPa) during part of a cycle, and if this pressure rise stays above atmospheric pressure long enough during a cycle, and this is high enough to overcome inertia and surface tension restoring forces, drops are ejected through the orifice. If the plate displacement amplitude is too small, the meniscus in the orifice simply oscillates up and down. If the frequency is too high, the pressure in the fluid does not remain above atmospheric long enough to eject a drop.

Figure 1:
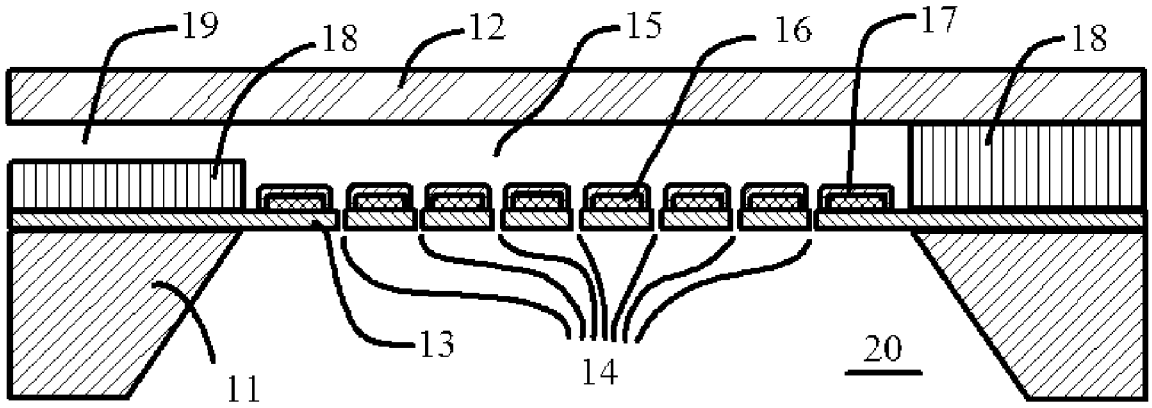
FIG. 1 is a cross-sectional view of a micromachined fluid ejector array according to one preferred embodiment of the present invention.
Figure 2:
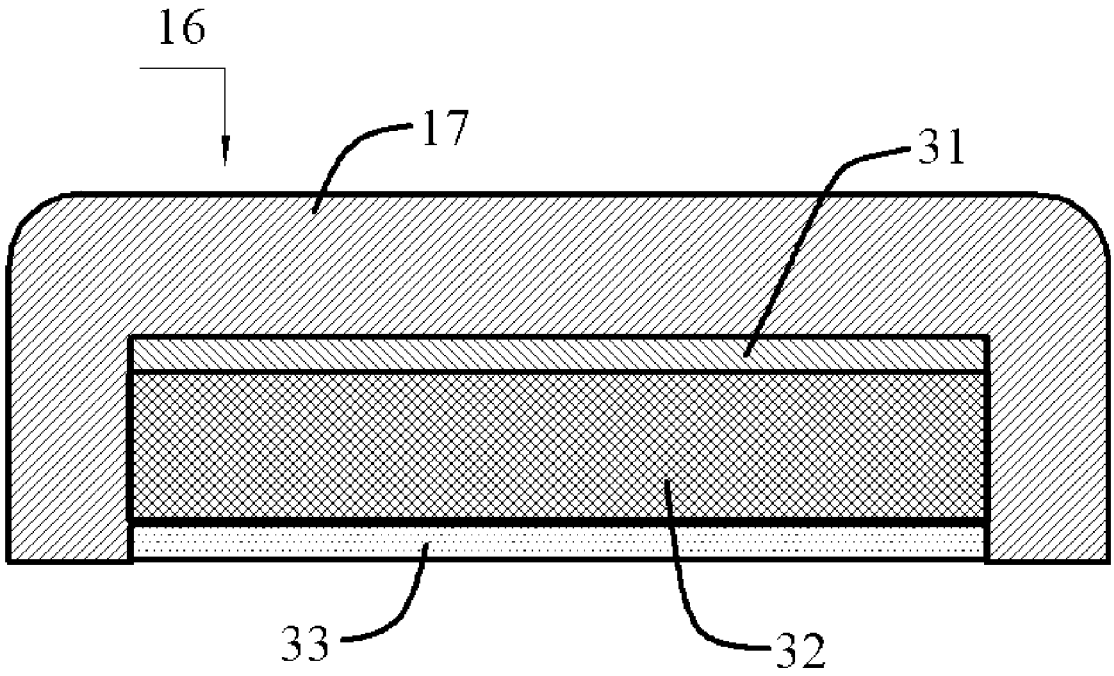
FIG. 2 shows a cross-sectional view of a micromachined capacitive fluid ejector array along the line A-A' in FIG. 3 according to another preferred embodiment of the present invention.

Referring to FIG. 1 now. This is a cross-sectional view of a micromachined fluid ejector array according to the preferred embodiment of current invention. The ejector array comprises a an elastic membrane 13 that has a scalable amount of orifices 14 on it and is supported by the silicon substrate 11. On top of the membrane 13, there are piezoelectric transducers 16 that are evenly spaced on them. Piezoelectric transducers 16, as shown in detail in FIG. 2, is comprised of an piezoelectric layer 32 coated with top electrode 31 and bottom electrode 33. An isolation layer 17, which prevents the electrode in direct contact with the fluid that is to be ejected, is coated on top of the top electrode 31. The elastic membrane 13 may be conductive, in which case it acts as a common electrode for transducers 16. A reservoir 15, which is used to store the fluid to be ejected, is bounded by the elastic membrane 13, sidewall 18 and a top cover 12. At one end of sidewall, an fluid inlet 19 is cut from the sidewall 18 to allow the fluid filling in the reservoir 15. Both sidewall 18 and top cover 19 may be made of plastics, PDMS, acrylics or other non-conductive materials, and bonded to the micromachined silicon base. The sidewall 18 and top cover 12 may also be micromachined by sacrificial etching. Cavity 20 is formed by etching away a part of bulk silicon during the micromachining.

Figure 3:
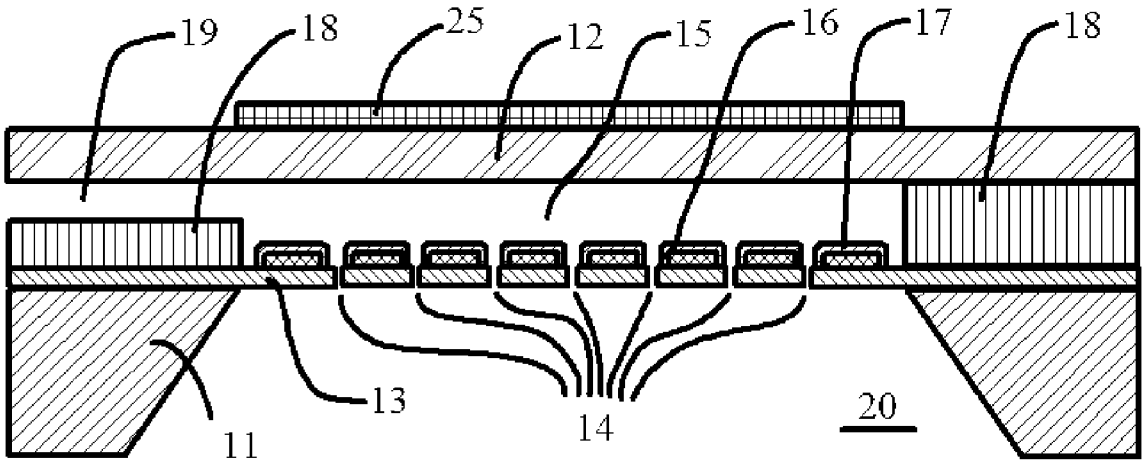

In another preferred embodiment, the top cover 12 has a piezoelectric layer 25 bonded on top of it. This is shown in FIG. 3. This piezoelectric layer 25 will vibrate transflexurally to cause the top cover 12 buckle up and down.

Figure 4:
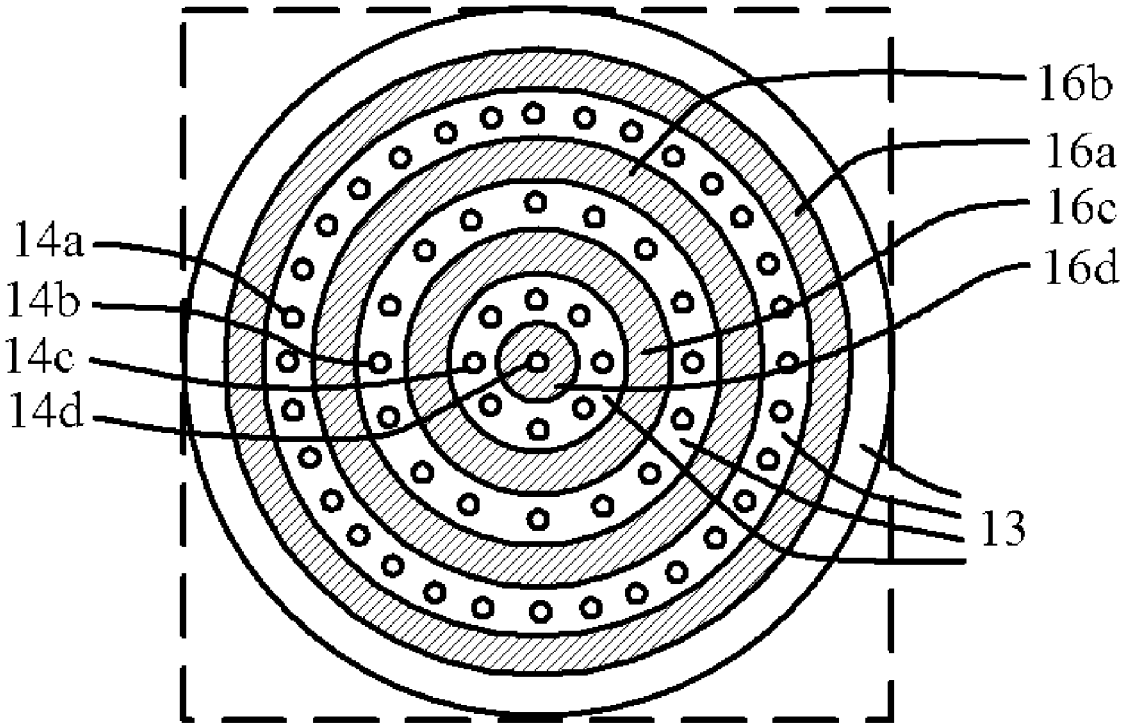
FIG. 4 shows a top plane view of a micromachined fluid ejector array according to one preferred embodiment of the present invention.

FIG. 4 shows the top plan view of the micromachined fluid ejector array according to preferred embodiment of present invention. Piezoelectric transducers 16*a*, 16*b*, 16*c* and 16*d* form concentric rings surrounding the center of fluid ejector array. These piezoelectric transducers 16 may have same width or different widths. Between neighboring piezoelectric transducers 16, there are a scalable array of orifices 14*a*, 14*b*, 14*c* and 14*d* drilled on the elastic membrane 13. The diameter of the orifices 14 may be same or different, depending on the particular applications. Orifices 14 are arranged uniformly at the center of neighboring piezoelectric transducers 16.

Figure 5:
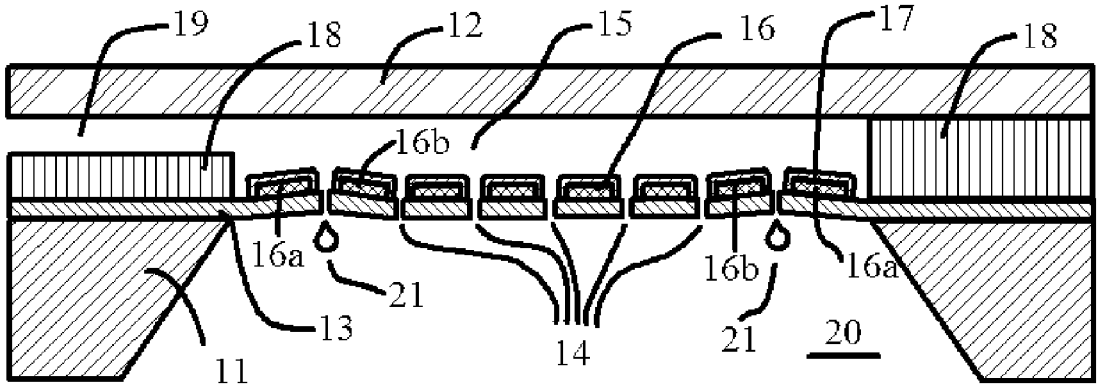
FIG. 5 shows a cross-sectional view of fluid ejection a micromachined fluid ejector array according to one preferred embodiment of the present invention.

In one mode of operation as illustrated in FIG. 5, the neighboring piezoelectric transducers 16*a* and 16*b* are applied with electric voltage to cause the elastic membrane 13 to deflect up and down. The orifices 14*a* that are arranged between them will vibrate to eject fluid droplets 21. Similarly, other orifices 14*b*, 14*c* and 14*d* may also be deflected to eject fluid droplets if transducers 16*b* and 16*c*, 16*c* and 16*d* are actuated. If all piezoelectric transducers 16 are actuated, all orifices 14 will eject fluid droplets at the same frequency that the piezoelectric transducers 16 are driven.

Figure 6:
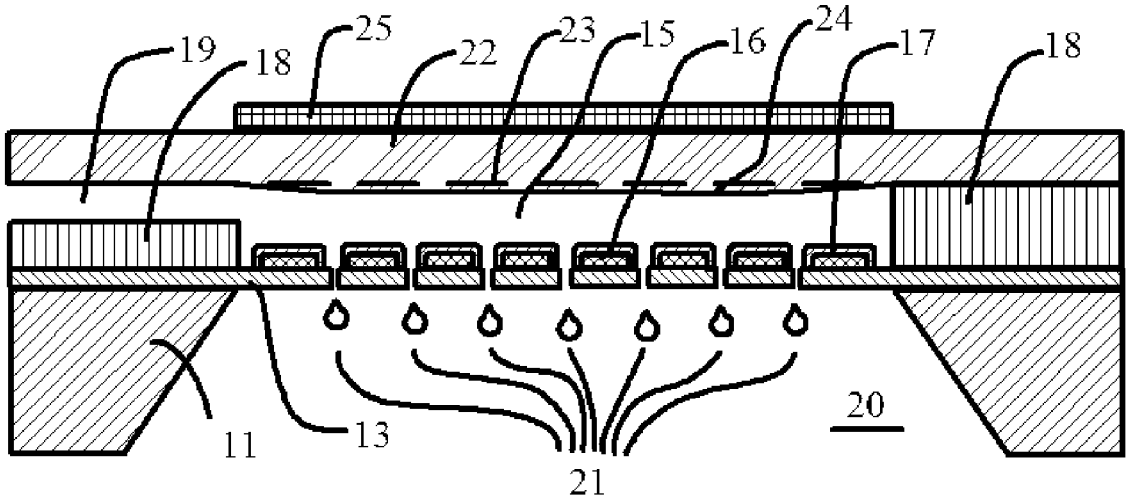
FIG. 6 shows a cross-sectional view of fluid ejection a micromachined fluid ejector array according to another preferred embodiment of the present invention.

In another mode of operation, the bulk actuation waves have an amplitude large enough to eject fluid droplets through orifices 14 in phase. This is illustrated in FIG. 6. The bulk actuation wave is generated by applying electric signals on piezoelectric layer 25. The alternating electric signal will cause the top cover 22 to buckle up and down to position 24. The buckling of top cover 22 generates the bulk pressure wave in fluid inside the reservoir 15. If this bulk pressure is large enough such that it overcomes the capillary forces that keep fluid in the orifices 14, the droplets 21 will be ejected from orifices 14.

Thickness mode piezoelectric transducers in either longitudinal or shear mode can be used for bulk actuation. Single or multiple (i.e. arrays of) thickness mode piezoelectric transducers can be used for the bulk actuation. The bulk actuation can be piezoelectric, piezoresistive, electrostatic, capacitive, magnetostrictive, thermal, pneumatic, etc. Piezoelectric, electrostatic, magnetic, capacitive, magnetostrictive, etc. actuation can be used for the array elements. The actuation of the original array elements can be performed by selectively activating the concentric piezoelectric transducers 16 associated with the array of orifices 14 to act as a switch to either turn on or turn off the ejection of drops. The meniscus of the orifice can always vibrate (not as much as for ejection) to decrease transient response, to decrease drying of the fluid and prevent self-assembling of the fluid ejected near the orifice. Excitation frequencies of bulk and individual array element actuations can be the same or different depending upon the application.

The devices eject fluids, small solid particles and gaseous phase materials. The droplet ejector can be used for inkjet printing, biomedicine, drug delivery, drug screening, fabrication of biochips, fuel injection and semiconductor manufacturing.

The thickness of the membrane in which the orifice is formed is small in comparison to the droplet (orifice size), which results in perfect break-up and pinch-off of the ejected droplets from the air-fluid interface. Although a silicon substrate or body having a cavity has been described, it is clear that the substrate or body can be other types of semi-conductive material, plastic, glass, metal or other solid material in which cylindrical reservoirs can be formed. Likewise, the apertured membrane has been described as silicon nitride or silicon. It can be of other thin, flexible material such as plastic, glass, metal or other material that is thin and not reactive with the fluid being ejected.

The foregoing descriptions of specific embodiments of the present invention are presented for the purposes of illustration and description. They are not intended to be exhaustive or to limit the invention to the precise forms disclosed; obviously many modifications and variations are possible in view of the above teachings. The embodiments were chosen and described in order to best explain the principles of the invention and its practical applications, to thereby enable others skilled in the art to best utilize the invention and various embodiments with various modifications as are suited to the particular use contemplated. It is intended that the scope of the invention be defined by the following claims and their equivalents.

What is claimed is:

1. A fluid ejector comprising:

a membrane comprising two or more concentric piezoelectric transducers, wherein a first of the two or more transducers surrounds a second of the two or more transducers; and, two or more nozzles through the membrane, wherein the nozzles are positioned between the two or more concentric transducers.

2. The ejector of claim 1, further comprising a fluid reservoir on a first side of the membrane.

3. The ejector of claim 2, wherein the nozzles are not isolated from each other by ribs on the first side of the membrane.

4. The ejector of claim 2, further comprising a cover aligned parallel to the membrane and comprising a bulk actuator.

5. The ejector of claim 4, wherein the bulk actuator is selected from the group consisting of: a piezoelectric actuator, a piezoresistive actuator, an electrostatic actuator, a capacitive actuator, a magnetostrictive actuator, a thermal actuator and a pneumatic actuator.

6. The ejector of claim 2, further comprising a fluid in the reservoir.

7. The ejector of claim 6, wherein the fluid comprises an ink, a drug or a fuel.

8. The ejector of claim 2, wherein a second side of the membrane borders a cavity into which the fluid can be ejected from the nozzles as droplets.

9. The ejector of claim 1, wherein one or more of the concentric transducers comprise a ring transducer.

10. A method of microfluid ejection, the method comprising:

providing a membrane comprising two or more concentric piezoelectric transducers, wherein a first of the two or more transducers surrounds a second of the two or more transducers; and comprising two or more nozzles positioned between the two or more concentric transducers;

providing a reservoir of fluid on a first side of the membrane; and, applying an electric voltage to one or more of the transducers;

thereby deflecting one or more nozzles and ejecting one or more droplets of the reservoir fluid from the one or more nozzles.

11. The method of claim 10, wherein the electric voltage is applied to the two or more piezoelectric transducers at once.

12. The method of claim 10, wherein the nozzles are not isolated from each other by ribs on the first side of the membrane.

13. The method of claim 10, wherein the fluid comprises an ink, a drug or a fuel.

14. The method of claim 10, further comprising:

providing a cover aligned parallel to the membrane and comprising a bulk actuator; and, actuating the bulk actuator.

15. The method of claim 14, wherein said actuating comprises generation of a bulk actuation wave characterized by an amplitude large enough to eject droplets from the two or more nozzles.

* * * * *